US007284463B2

(12) United States Patent
DeCelles et al.

(10) Patent No.: US 7,284,463 B2
(45) Date of Patent: Oct. 23, 2007

(54) ATTACHMENT FOR A SOCKET WRENCH, AND METHOD

(75) Inventors: Donald DeCelles, Overland Park, KS (US); David Alan Barr, Overland Park, KS (US); David E Herron, Kansas City, KS (US)

(73) Assignee: Great Ideas, LLC, Overland Park, KS (US)

( * ) Notice: Subject to any disclaimer, the term of this patent is extended or adjusted under 35 U.S.C. 154(b) by 0 days.

(21) Appl. No.: 11/496,904

(22) Filed: Aug. 1, 2006

(65) Prior Publication Data

US 2007/0028723 A1 Feb. 8, 2007

Related U.S. Application Data

(60) Provisional application No. 60/704,306, filed on Aug. 2, 2005.

(51) Int. Cl.
*B25B 23/142* (2006.01)
*B25B 17/02* (2006.01)
*B25B 29/00* (2006.01)

(52) U.S. Cl. ..... 81/57.29; 81/57.3; 81/57.14

(58) Field of Classification Search ..... 81/57.14, 81/57.29, 57.3, 57.31, 180.1, 467
See application file for complete search history.

(56) References Cited

U.S. PATENT DOCUMENTS

| | | | | | |
|---|---|---|---|---|---|
| 2,520,443 | A * | 8/1950 | Seaquist | 475/3 |
| 3,472,083 | A * | 10/1969 | Schnepel | 475/317 |
| 4,069,726 | A * | 1/1978 | Garconnet | 475/317 |
| 4,179,955 | A * | 12/1979 | Akiyoshi et al. | 81/57.11 |
| 4,459,882 | A * | 7/1984 | Hayashi | 81/477 |
| 4,475,420 | A * | 10/1984 | Atkinson et al. | 81/58.3 |
| 5,058,463 | A | 10/1991 | Wannop | |
| 5,176,047 | A * | 1/1993 | Bai et al. | 81/57.3 |
| 5,257,556 | A * | 11/1993 | Pineault | 81/124.2 |
| 5,277,087 | A | 1/1994 | Wilson | |
| 5,616,095 | A * | 4/1997 | Pruitt | 475/178 |
| 6,012,359 | A * | 1/2000 | Lin | 81/57.31 |
| 6,457,385 | B1 * | 10/2002 | Hu | 81/57.3 |
| 6,568,298 | B1 | 5/2003 | Zinck | |
| 6,662,688 | B1 | 12/2003 | Avery | |
| 2003/0213340 | A1 | 11/2003 | Alden | |
| 2005/0039579 | A1 * | 2/2005 | Wallace | 81/57.3 |

* cited by examiner

*Primary Examiner*—David B Thomas
(74) *Attorney, Agent, or Firm*—David E. Herron, II

(57) ABSTRACT

The invention includes an attachment for a socket wrench that is capable of imparting torque about an axis simultaneously in opposite directions. The invention also includes a method for imparting torque about an axis simultaneously in opposite directions.

20 Claims, 6 Drawing Sheets

ATTACHMENT FOR A SOCKET WRENCH, AND METHOD

SUMMARY OF THE INVENTION

The invention is:

(1) an attachment for a socket wrench that is capable of imparting torque about an axis simultaneously in opposite directions, and (2) a method for imparting torque about an axis simultaneously in opposite directions.

The Inventive Attachment

The inventive attachment includes a housing that has an outer face with a socket configured to receive a driving member of the socket wrench. The inventive attachment further includes a post that extends outwardly from the housing from an inner face that is positioned within the housing. At least one gripper arm extends radially outward from the housing. Further, the invention includes a means for a imparting rotating torque to the at least one gripper arm. Specifically, the rotating torque imparted to the at least one gripper arm will be in a direction opposite the torque imparted to the driving member of the socket wrench.

The inventive attachment may also include a pair of gripper arms, which may be oppositely disposed. The invention may also include extensions attachable to ends of the gripper arms. These extensions should be configured to assist in imparting torque to a rotatable feature or fixture.

In a preferred embodiment of the inventive attachment, the means for imparting rotating torque will include a lower gear having gear teeth positioned on its circumference, and an internally-configured upper gear. Additionally, a plurality of middle gears is positioned between the upper gear and the lower gear. Each of these middle gears bears gear teeth that engage gear teeth of the upper gear and also engage gear teeth of the lower gear.

Optionally, the lower and middle gears fit inside the upper gear. It is also preferred that the plurality of middle gears comprises three gears. These gears may be equally displaced from one another. The inventive attachment may also have a lower ear that includes a circular inner portion and an outer portion that is rotatable relative the inner portion.

The inventive attachment for a socket wrench may also include a bracket mounted adjacent the post and configured to retain each of the middle gears in a spaced-apart relation. In this preferred embodiment of the attachment for a socket wrench, the attachment may include a plurality of axles mounted to the bracket with a respective middle gear mounted to each respective axle. Further, the bracket may be free to rotate relative the post.

Another embodiment of the inventive attachment for a socket wrench, will include a housing and an internally-configured upper gear having an open interior portion. This embodiment will also have a lower gear positioned within the interior portion and having an outer face bearing a socket configured to receive a driving member of the socket wrench. The lower gear will also bear inner face having a driving post extending therefrom. This driving post will protrude from the housing.

A plurality of middle gears will be positioned within the interior portion of the upper gear. Each middle gear will have gear teeth that engage gear teeth on each of the upper gear and lower gear. This embodiment will also include a pair of gripper arms, each extending radially outward from the upper gear. Imparting a torque to the wrench in a first direction about the post causes the gripper arms to rotate about the post in a direction opposite the first direction.

Optionally, the lower gear includes a circular inner portion and an outer portion that is rotatable relative the inner portion. In this embodiment, the invention may include a plurality of axles mounted on the outer portion of the inner face of the lower gear such that each middle gear is rotatably mounted about a respective axle. This embodiment may also have a bracket configured to receive terminal ends of each respective axle. If a bracket is included in this embodiment, it should prohibit relative rotation of the bracket with respect to the driving post.

In an alternate embodiment, the lower gear is a unitary, monolithic one-piece structure. In this alternate embodiment, the invention includes a bracket that is free to rotate relative the post. Axles are then mounted to the bracket, and each middle gear is rotatably mounted to a respective axle. In either embodiment, it is preferred that the plurality of middle gears comprises three gears that are equally displaced from one another.

The attachment may also include a means for limiting or restricting the relative movement of the driving post with respect to the bracket. This means may include an arcuate extension positioned between the lower gear and the driving post. The arcuate extension should bear a centroid that is displaced from the longitudinal axis. Additionally, an externally configured central gear is positioned on the upper surface of the lower gear. The central gear will have o-shape with an open interior and a diameter shorter than the lower gear. When the attachment is fully assembled, the arcuate extension fits within the interior portion of the central gear. There will be internally configured gear teeth formed on the bracket, and these internally-configured gear teeth will mate with teeth on the central gear. Thus, when the wrench is turned, the arcuate extension causes the central gear to engage the teeth on the bracket.

The Inventive Method

The invention is also a method of imparting torque simultaneously in opposite directions about a single axis. The method will include the step of providing a socket socket wrench, having a driving member, and also providing an attachment for the socket wrench. The attachment will have an internally-configured upper gear having an open interior portion.

The method will also include the step of positioning a lower gear within the interior portion of the upper gear. The lower gear will have an outer face bearing a socket configured to receive the driving member of the socket wrench, and an inner face having a driving post extending therefrom. The driving post should protrude from the housing. The method will also include the step of positioning a plurality of middle gears within the interior portion so that each middle gear engages gear teeth on each of the upper gear and lower gear.

Additionally, a pair of gripper arm will be extended radially outward from the upper gear. Further, the method includes the steps of engaging the gripper arms with an item that is to be torqued opposite a chosen direction about the axis, and also imparting a torque to the wrench in the chosen direction about the axis orthogonal the socket.

The inventive method may also include the step of forming the lower gear to include a circular inner portion and an outer portion that is rotatable relative the inner portion, and it may also include the mounting of at least one axle (or preferably a plurality of axles) on the outer portion of the inner face of the lower gear. The method may also include the step of rotatably mounting a respective middle gear about each axle. Preferably, there will be three axles—each having a middle gear rotatably mounted thereto—that are equally displaced from one another.

The method may also include the step of configuring a bracket to receive terminal ends of each respective axle, the bracket being mounted adjacent the driving post. Optionally, this bracket may prohibit relative rotation of the bracket with respect to the post.

In another embodiment, the lower gear is a unitary, monolithic one-piece structure, and the method includes the step of rotatably mounting a bracket adjacent the driving post, then positioning respective axles on the bracket; and rotatably mounting a respective middle gear onto each respective axle.

The inventive method may also include the step of positioning an arcuate extension between the lower gear and the driving post, and forming, the arcuate extension to bear a centroid that is displaced from the longitudinal axis. The method may also include the step of positioning an externally configured central gear on the upper surface of the lower gear. The central gear will have an o-shape with an open interior and a diameter shorter than the lower gear. The arcuate extension fits within the interior portion of the central gear.

The inventive method may also include the step of forming internally configured gear teeth formed on the bracket, and ascertaining that these internal gear teeth are configured to mate with teeth on the central gear. As the wrench is turned, the arcuate extension causes the central gear to engage the teeth on the bracket, thereby limiting or restricting the relative movement of the bracket relative the post.

The inventive method may also include the steps of configuring a bracket to receive terminal ends of respective axles, and rotatably mounting a respective middle gear about each axle. This embodiment may also include the step of rotatably mounting the bracket adjacent the driving post.

Additionally, the inventive method may also include the step of limiting relative rotation of the circular inner portion with respect to the outer portion. Specifically, this may be accomplished by rotatably mounting a bracket to the driving post, wherein the bracket configured to retain the middle gears in a spaced apart relation. This preferred embodiment of the method will include positioning an arcuate extension between the driving post and the top face of middle gear, and extending the arcuate extension laterally away from the axis. There are gear teeth positioned on an inner portion of the bracket, and the method may also include placing a central gear on the top face of the lower gear. The central gear having an open interior portion enabling the arcuate extension to fit therein, wherein, rotation of the wrench about the longitudinal axis causes the arcuate extension to press the central gear into engagement with the gear teeth formed on the inner portion of the bracket.

In another embodiment, the method may include the steps of providing a bracket, and then rotatably mounting the bracket adjacent the driving post. The method may also include positioning respective axles on the bracket, and then rotatably mounting a respective middle gear onto each respective axle. The middle gears may include three gears, and equally displacing the middle gears from one another.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
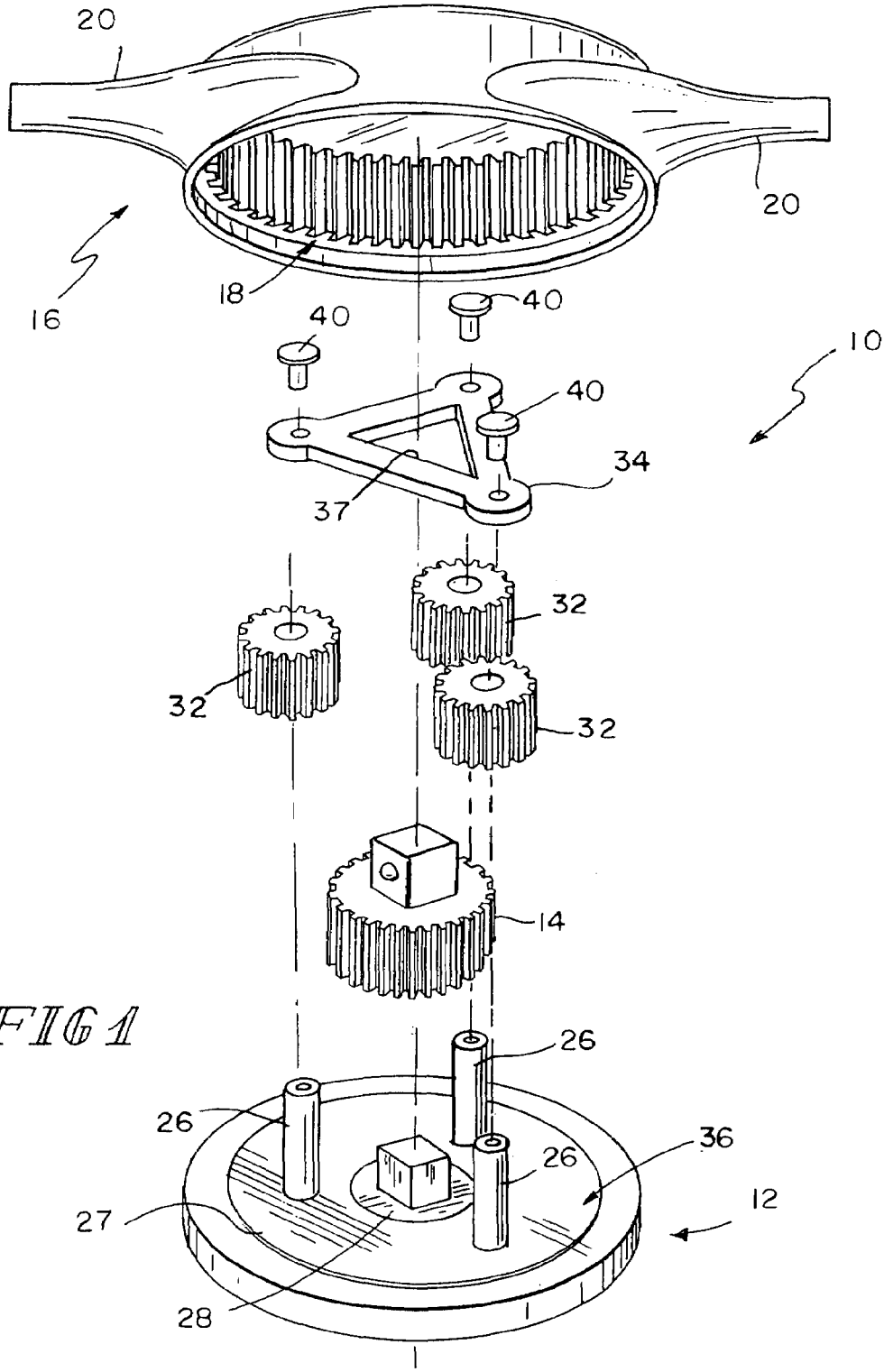
FIG. 1 is an exploded view showing a first preferred embodiment of the invention.

FIG. 1 is an exploded view detailing the working parts of the attachment 10. As shown, the attachment 10 includes a lower part 12 having an inner face 27. The inner face 27 comprises an inner portion 28 and an outer portion 30 that is free to rotate relative the inner portion 28.

Still referring to FIG. 1, the invention will also include a lower gear 14 mounted to the inner portion 28 of the inner face 27. The lower gear 14 is shown detached from the inner portion 28, but in fact the lower gear 14 and the inner portion 28 may be unitary and formed as a single, monolithic, one-piece structure having a post 24 positioned an end distal the inner face 27, the post being configured to protrude the housing of the attachment 10, and further configured to receive a socket attachment (not shown).

As shown in FIG. 1, a plurality of axles 26 are mounted to the inner face 27 on the outer portion 30 thereof. A respective middle gear 32 is rotatably mounted on each axle 26. The upper part 16 includes a upper gear 18 having gear teeth formed to engage the teeth of each respective middle gear 32. Preferably, the upper part 16 is configured so that it allows the post 24 to protrude, yet maintains the middle gears 32 on their respective axles.

Still referring to FIG. 1, this embodiment may also include a bracket 34 mounted at terminal ends of each axle 26 in order maintain the middle gears 32. Also, h a pair of gripper arms 20 that extend radially outward from the upper part 16. The gripper arms 20

Still referring to an FIG. 1, the attachment 10 may also include a plurality of pins 40 that pass through openings in the bracket 34 to assist in retaining the middle gears 32 in a spaced-apart relation. Additionally, the pins 40, if longer than shown, may eliminate the need for axles 26 entirely, as the pins 40, acting alone, could provide an axle of rotation for each of the middle gears, and meanwhile hold the middle gears 32 in a spaced-apart relation. Optionally, the pins 40 may insert within the axles 26 to help hold the bracket 34 in place.

Figure 2:
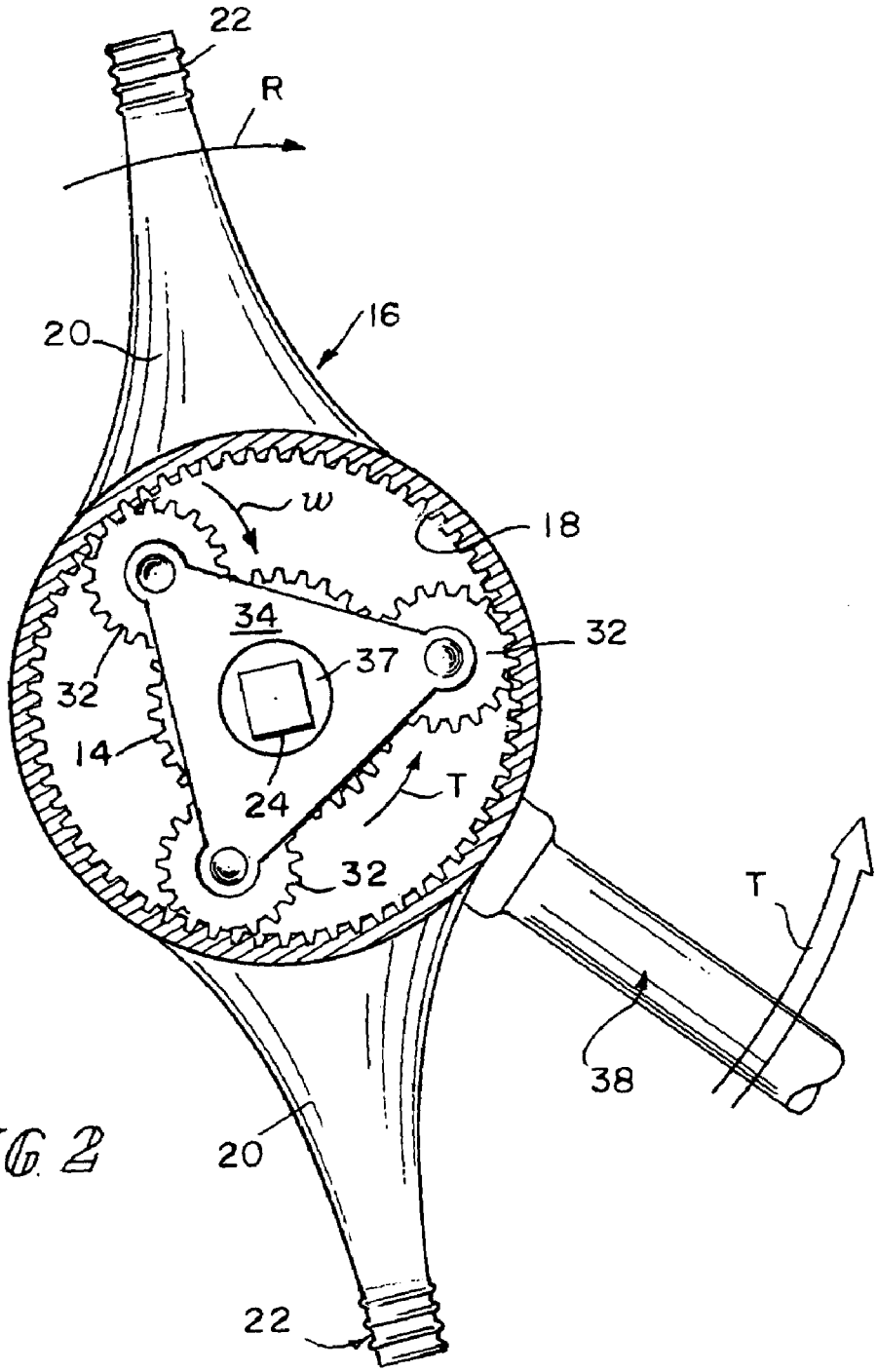
FIG. 2 shows a plan view detailing the interior parts of the first embodiment of the invention

FIG. 2 shows a detailed view of the relationship between the upper part 16, the upper gear 18, and the middle gears 32. As a rotating torque T is imparted to the wrench 38, the lower gear will also turn in direction T (counter-clockwise). This counter-clockwise rotation of the lower gear 14 will cause middle gears 32 to rotate in direction ω (clockwise). In turn, the rotation of the middle gears 32 will transfer a tendency to rotate the upper gear 18 in the direction R (clockwise). In preferred embodiments, the upper gear 18 and the upper part 16 are integrally formed as a unitary, monolithic, one-piece structure. As such, the rotation of the upper gear 18 will impart rotating torque to tripper arms 20. The terminal ends 22 of the gripper arms may be threaded in order to accommodate any type of arm extension (not shown in FIG. 2, but shown hereinafter).

Still referring to FIG. 2, the driving post 24 is positioned atop the lower gear 14 and will protrude through an opening 37 in the bracket 34. As the attachment 10 rotates, the driving post 24 will rotate relative the bracket; as such, it is important that the bracket 34 have an opening 37 sufficiently large to enable free movement therein.

Figure 3:
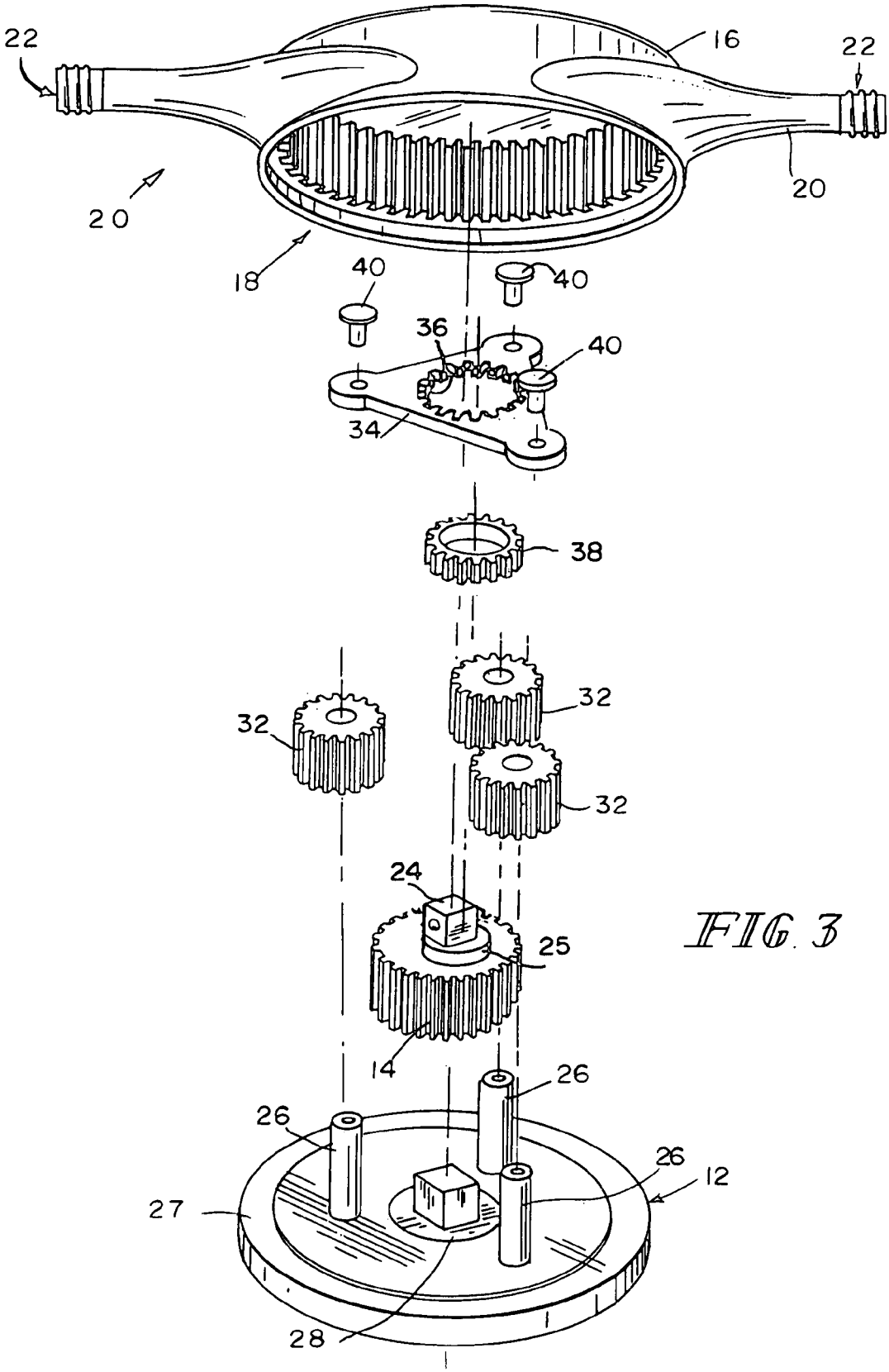
FIG. 3 is an exploded view showing a second preferred embodiment of the invention.

FIG. 3 shows a second preferred embodiment of the attachment 10. As shown, the attachment 10 includes a lower part 12 having an inner face 27. The inner face 27 comprises an inner portion 28 and an outer portion 30 that is free to rotate relative the inner portion 28.

As shown in FIG. 3, the invention will also include a lower gear 14 mounted to the inner portion 28 of the inner face 27. The lower gear 14 is shown detached from the inner portion 28, but in fact the lower gear 14 and the inner portion 28 may be unitary and formed as a single, monolithic, one-piece structure having a post 24 positioned an end distal the inner face 27, the post being configured to protrude the housing of the attachment 10, and further configured to receive a socket attachment (not shown).

As shown in FIG. 3, a plurality of axles 26 are mounted to the inner face 27 on the outer portion 30 thereof. A respective middle gear 32 is rotatably mounted on each axle 26. The upper part 16 includes a upper gear 18 having gear teeth formed to engage the teeth of each respective middle gear 32. Preferably, the upper part 16 is configured so that it allows the post 24 to protrude, yet maintains the middle gears 32 on their respective axles.

Still referring to FIG. 3, this second preferred embodiment includes a bracket 34 mounted at terminal ends of each axle 26 in order maintain the middle gears 32. Also, a pair of gripper arms 20 that extend radially outward from the upper part 16. The gripper arms 20 may have ends 22 to receive attachments (not shown in FIG. 3; viewable in FIG. 7).

FIG. 3 also shows that the attachment 10 may also include a plurality of pins 40 that pass through openings in the bracket 34 to assist in retaining the middle gears 32 in a spaced-apart relation. Additionally, the pins 40, if longer than shown, may eliminate the need for axles 26 entirely, as the pins 40, acting alone, could provide an axle of rotation for each of the middle gears, and meanwhile hold the middle gears 32 in a spaced-apart relation. Optionally, the pins 40 may insert within the axles 26 to help hold the bracket 34 in place.

The embodiment shown in FIG. 3 is similar to the embodiment shown in FIG. 1 in many ways; however, this preferred embodiment shown in FIG. 3 also has a means to confine or limit the relative movement of the bracket 34 with respect to the driving post 24. In this embodiment, the opening 36 of the bracket 34 bears gear teeth formed to mate with teeth formed on central gear 38. The central gear 38 will rest on a top surface of the lower gear 14, and will have an open interior.

Still referring to FIG. 3, an arcuate extension 25 extends outwardly from the axis of rotation, is positioned between the driving post and the upper surface of the lower gear 14. The arcuate extension 25 has a centroid displaced from the axis of rotation, thereby providing an off-center rotating effect when one imparts turning torque to the socket wrench (not shown).

Still referring to FIG. 3, the arcuate extension 25 will engage a wall of the open interior of the central gear 38, and will compel engagement between the teeth of the central gear 38 and the teeth on the bracket 34. The ratio of the gear teeth on the central gear 38 and the gear teeth on the opening 36 of the bracket 34 should be sufficiently small in order to limit or inhibit the relative rotation of the bracket 34 about the axis of rotation.

Figure 4:
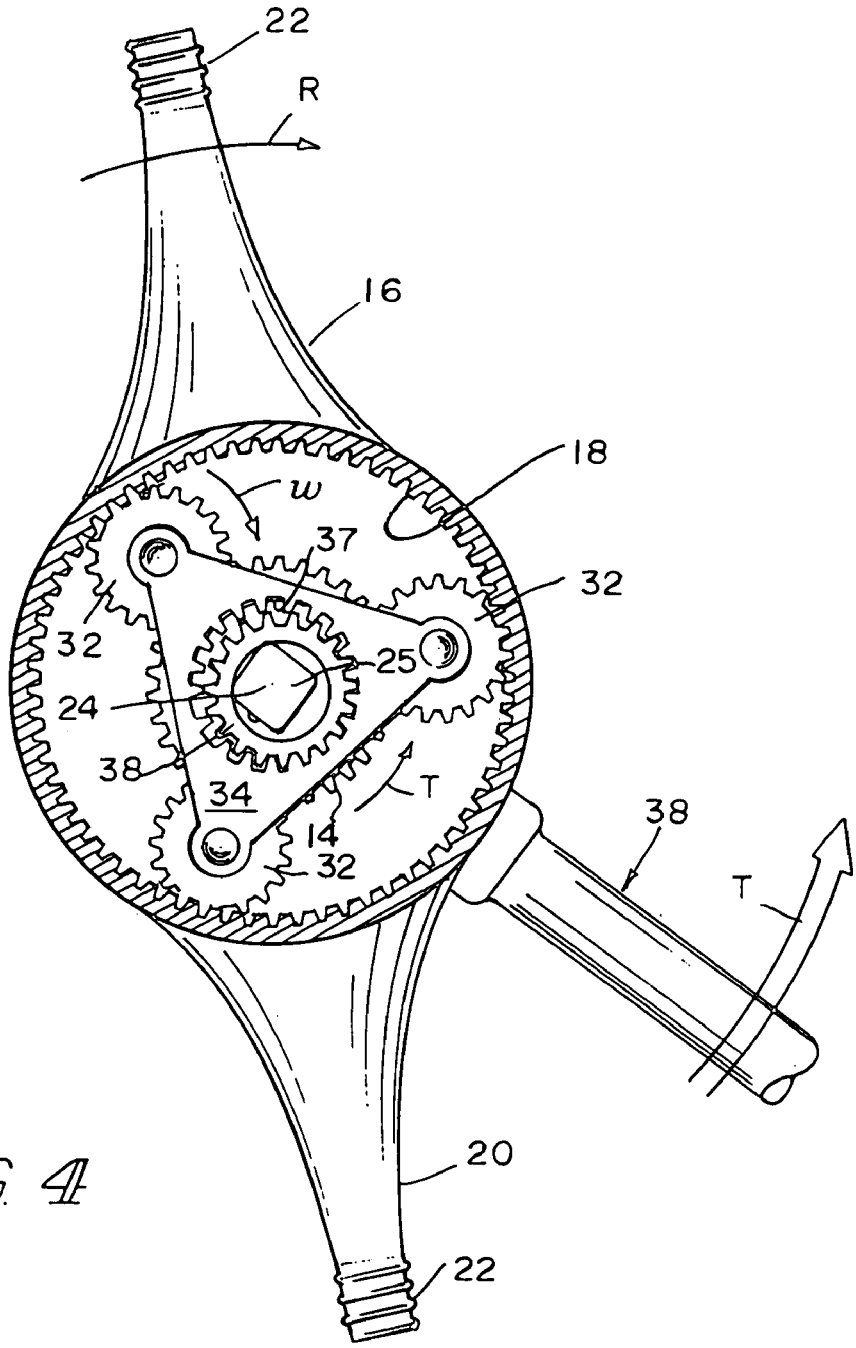
FIG. 4 shows a plan view detailing the interior parts of the second embodiment of the invention.

FIG. 4 shows a detailed view of the relationship between the top part 16, the upper gear 18, and the middle gears 32 of the embodiment shown in the exploded view of FIG. 3. As a rotating torque T is imparted to the wrench 38, the lower gear 14 will also turn in direction T (counter-clockwise). This counter-clockwise rotation of the lower gear 14 will cause middle gears 32 to rotate in direction w (clockwise). In turn, the rotation of the middle gears 32 will transfer a tendency to rotate the upper gear 18 in the direction R (clockwise). In preferred embodiments, the upper gear 18 and the top part 16 are integrally formed as a unitary, monolithic, one-piece structure. As such, rotation of the upper gear 18 will impart rotating torque to gripper arms 20. The terminal ends 22 of the gripper arms may be threaded in order to accommodate any type of arm extension (not shown in FIG. 4, but shown hereinafter). Alternatively, the extensions may be clipped on, or may comprise sleeves that wrap around the gripper arms 20. Further, the attachments may also be inserted into apertures or openings (not shown) on the gripper arms.

Still referring to FIG. 4, the driving post 24 is positioned atop the lower gear 14 and will protrude through an opening 37 in the bracket 34. The top face of the lower gear 14 includes an arcuate extension 25 that extends laterally outward from the axis of rotation, and has a centroid displaced from the axis.

As shown in FIG. 4, the arcuate extension 25 fits within the central gear 38. The arcuate extension 25, the central gear 38, and the opening 37 of the bracket 34 are cooperatively formed so that, as a rotating torque T is imparted, the arcuate extension 25 slides along the inner surface of the central gear, and thereby urges the central gear 38 to engage gear teeth formed on the edge of the opening 37 of the bracket, forcing a slight angular rotation of the bracket 34 with respect to the driving post 24.

Figure 5:
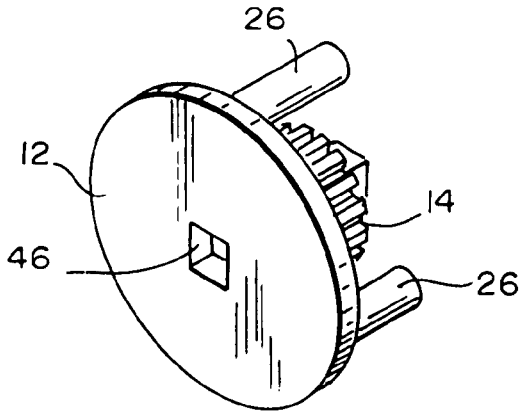
FIG. 5 is a perspective and isolated view showing a view of the bottom part of the attachment for a socket wrench.

FIG. 5 is an isolated perspective view showing the bottom part 12. The bottom part 12 includes a socket 46 centrally formed on its bottom face and configured to receive the driving member (not shown) of a socket wrench. Axles are formed on the opposite face of the bottom part 12, and are positioned around the lower gear 14, which is generally concentrically mounted on this opposite face as well.

Figure 6:
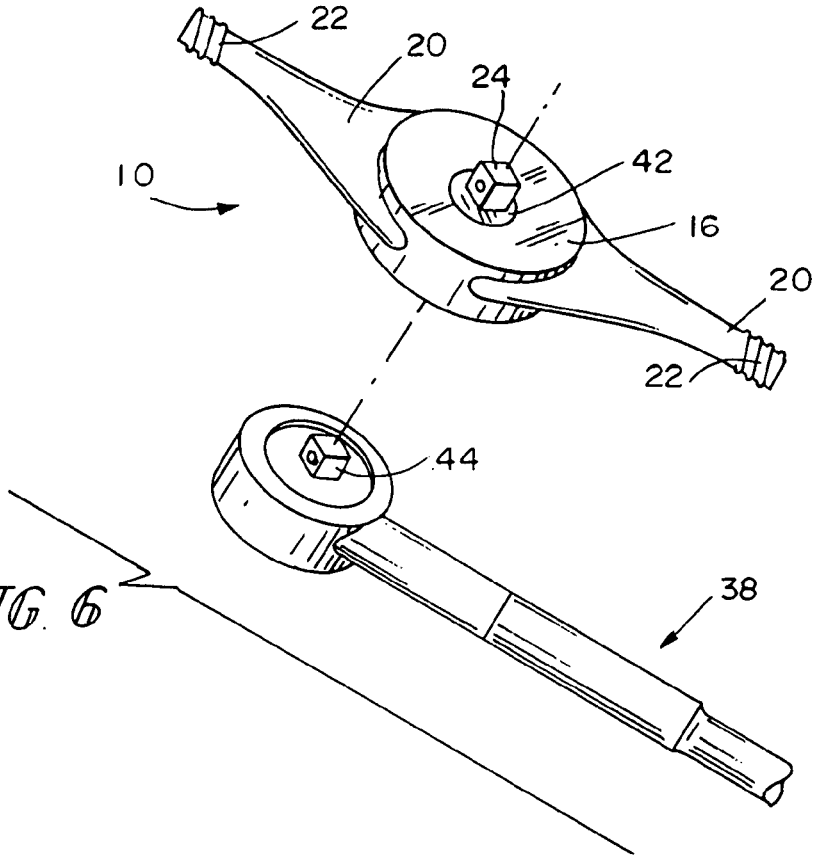
FIG. 6 is a perspective view showing the fully-assembled attachment in combination with a socket wrench.

FIG. 6 is a perspective view showing how the attachment 10 can be used in combination with a socket wrench 38. The driving member 44 of the socket wrench 38 fits into a socket (not visible) formed in the bottom part (not visible) of the attachment 10. As shown, the top part 16 of the attachment has an opening 42 that allows the driving post 24 to protrude outwardly therefrom. In this embodiment, the top part 16 envelopes the bottom part, making it entirely obscured from this view.

FIG. 6 also shows that the top part 16 may comprise a removable lid having an opening 42 that allows the driving post 24 to protrude; optionally, the top part 16 can be formed as a unitary, monolithic, one piece structure. Furthermore, in a preferred embodiment, the top part 16 and gripper arms 20 comprise a single, unitary, monolithic structure as well.

Figure 7:
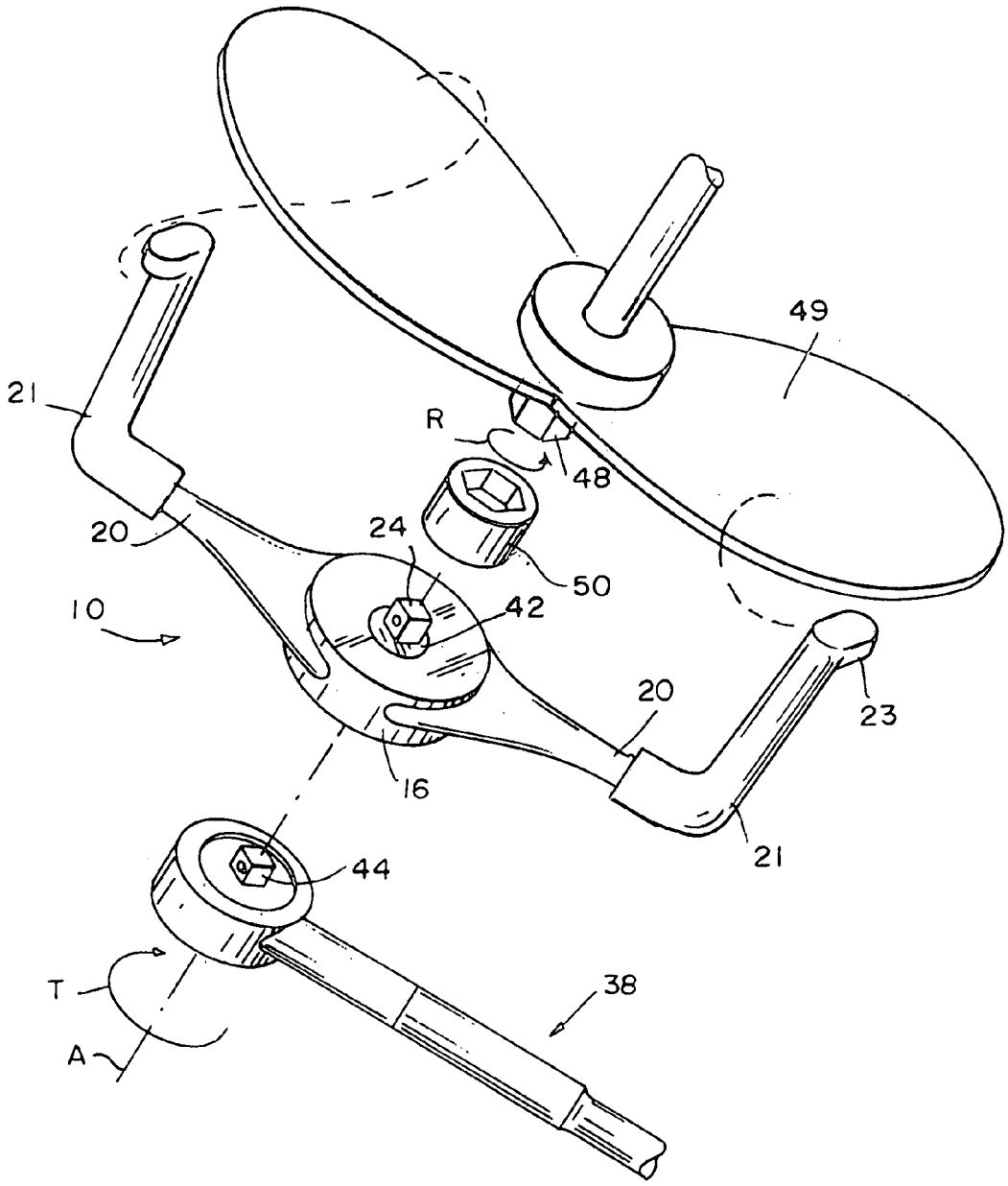
FIG. 7 is an exploded perspective view showing the attachment in combination with a socket wrench, according to the principles of the invention, being used to tighten a propeller or fan blade.

FIG. 7 shows an exploded view detailing how the attachment 10 can be used in combination with a socket wrench 38 in order to tighten a nut 48 on a rotatable item, such as a fan blade 49. The attachment includes a driving post 24 protruding through opening 42 in the top part 16. The driving post 24 will impart torque in the direction T about axis A, and will mate with a socket attachment 50 selected to fit the size of the nut 48. While the driving post turns the nut 48 in direction T about axis A, the gripper arms (and attachments) will impart torque to the item 49 in the opposite direction, alias direction R, about axis A.

As shown in FIG. 7, a pair of attachments 21 may be annexed to the gripper arms 20. Optionally, the attachments 21, may have hook-like ends 23 formed to assist in gripping or grabbing the item 49; alternatively, the ends 23 may be padded in order to prevent scratching or damaging the item 49.

Having described and illustrated the invention in detail, it is to be understood that the above and foregoing is for illustration and demonstration only. The descriptions herein are not intended to limit the breadth of this invention.

We claim:

1. An attachment for a socket wrench, comprising:

A housing with an outer face having a socket configured to receive a driving member of the socket wrench;

an inner face facing inside the housing and having a driving post extending orthogonally therefrom and protruding from the housing, the driving post configured to transmit a torque about a longitudinal axis;

at least one gripper arm extending radially outward from the housing and adapted to engage a structure rotatable about the longitudinal axis;

a means for a imparting rotating torque to the structure through the at least one gripper arm, the rotating torque being in a direction about the longitudinal axis that is opposite the torque imparted to the driving member of the socket wrench.

2. The attachment for a socket wrench as in claim 1, wherein:

the at least one gripper arm includes two gripper arms.

3. The attachment for a socket wrench as in claim 1, wherein the at least one gripper arm includes a pair of oppositely-disposed gripper arm.

4. The attachment for a socket wrench as in claim 1, wherein the means for imparting rotating torque includes:

a lower gear with gear teeth positioned on its circumference, and the socket configured to receive the driving member;

an internally-configured upper gear;

a plurality of middle gears, each positioned between the upper gear and the lower gear and each middle gear bearing gear teeth configured to engage gear teeth of the upper gear and gear teeth of the lower gear.

5. The attachment for a socket wrench as in claim 4, wherein the lower gear and the middle gears fit inside the upper gear.

6. The attachment for a socket wrench as in claim 4, wherein the plurality of middle gears comprises three gears that are equally displaced from one another.

7. The attachment for a socket wrench as in claim 4, wherein the inner face comprises a circular inner portion and an outer portion; and wherein, the outer portion is rotatable relative the inner portion.

8. The attachment for a socket wrench as in claim 4, further comprising a bracket mounted adjacent the post and configured to retain each of the middle gears.

9. The attachment for a socket wrench as in claim 8, further comprising a plurality of axles mounted to the bracket; wherein, a respective middle gear is mounted to each respective axle; and wherein, the bracket is mounted to be rotatable relative the driving post.

10. The attachment for a socket wrench as in claim 9, further comprising:

an arcuate extension positioned between the lower gear and the driving post, the arcuate extension having a centroid that is displaced from the longitudinal axis;

an externally configured central gear positioned on the upper surface of the lower gear and having o-shape an open interior, the central gear having a diameter shorter than the lower gear, and wherein the arcuate extension fits within the interior portion of the central gear;

internally configured gear teeth formed on the bracket, and further configured to mate with teeth on the central gear; wherein, the arcuate extension causes the central gear to engage the teeth on the bracket.

11. An attachment for a socket wrench, comprising:

a housing including a top part and a bottom part;

an internally-configured upper gear having an open interior;

a lower gear having a bottom face bearing a socket configured to receive a driving member of the socket wrench, and a top face having a driving post extending therefrom, the lower gear being positioned within the interior of the upper gear and;

a plurality of middle gears positioned within the interior portion and between the upper gear and the lower gear, each middle gear configured to engage gear teeth on each of the upper gear and lower gear;

a pair of gripper arms, each extending radially outward from the upper gear and adapted to engage a structure rotatable about the longitudinal axis; wherein, imparting a torque to the wrench in a first direction about an axis of rotation causes the gripper arms to impart a torque to the structure in a direction opposite the first direction.

12. An attachment for a socket wrench as in claim 11, wherein the bottom part of the housing includes a circular inner portion and an outer portion that is rotatable relative the inner portion.

13. An attachment for a socket wrench as in claim 12, further comprising:

a plurality of axles mounted on the outer portion; and, each middle gear is rotatably mounted about a respective axle.

14. An attachment for a socket wrench as in claim 11, further comprising a bracket mounted so that it is rotatable relative the driving post and configured to receive terminal ends of respective axles; wherein, each middle gear is rotatably mounted to a respective axle.

15. An attachment for a socket wrench as in claim 14, wherein the bracket is rotatably mounted to the driving post.

16. An attachment for a socket wrench as in claim 15, further comprising an arcuate extension positioned between the driving post and the top of the middle gear, and extending laterally away from the axis of rotation;

gear teeth formed on an inner portion of the bracket;

a central gear positioned on an upper surface of the lower gear, and having an open interior portion enabling the arcuate extension to fit therein, wherein, the arcuate extension, the central gear, and the bracket are cooperatively formed so that rotation of the wrench about the axis urges the arcuate extension to press the central gear into engagement with the gear teeth formed on the inner portion of the bracket.

17. The attachment for a socket wrench as in claim 11, wherein the plurality of middle gears comprises three gears that are equally displaced from one another.

18. A method of imparting torque simultaneously in opposite directions about an axis, the method comprising the steps of:

providing a socket socket wrench, having a driving member;

providing an attachment for the socket wrench, the attachment having an internally-configured upper gear with an open interior portion;

providing a housing having a top part and a bottom part;

positioning a lower gear within the interior portion of the upper gear, the lower gear having a bottom face bearing a socket configured to receive the driving member of the socket wrench, and a top face with a driving post extending therefrom;

positioning a plurality of middle gears within the interior portion so that each middle gear engages gear teeth on each of the upper gear and lower gear;

extending a pair of gripper arms radially outward from the upper gear;

engaging the gripper anus with a structure that is to be torqued opposite a chosen direction about the axis; and, imparting a torque to the wrench in the chosen direction about the axis.

19. The method as in claim 18, further comprising the steps of forming the bottom part of the housing to include a circular inner portion and an outer portion that is rotatable relative the inner portion.

20. The method as in claim 19, further comprising the steps of:

mounting a plurality of axles on the outer portion; and, rotatably mounting a respective middle gear about each respective axle.

* * * * *